US010659856B1

(12) United States Patent
Pierce et al.

(10) Patent No.: US 10,659,856 B1
(45) Date of Patent: May 19, 2020

(54) AUDITORY LOW FREQUENCY SOUND REPRODUCTION AND VIBRATION GENERATING SPEAKER ENCLOSURE PLATFORM SYSTEM

(71) Applicants: Christopher Alan Pierce, Oak View, CA (US); Timothy Alan Pierce, Oak View, CA (US)

(72) Inventors: Christopher Alan Pierce, Oak View, CA (US); Timothy Alan Pierce, Oak View, CA (US)

( * ) Notice: Subject to any disclaimer, the term of this patent is extended or adjusted under 35 U.S.C. 154(b) by 0 days.

(21) Appl. No.: 16/380,074

(22) Filed: Apr. 10, 2019

Related U.S. Application Data

(60) Provisional application No. 62/658,038, filed on Apr. 16, 2018.

(51) Int. Cl.
*H04R 1/02* (2006.01)
*H04R 5/02* (2006.01)
*H04R 1/28* (2006.01)

(52) U.S. Cl.
CPC ..... *H04R 1/025* (2013.01); *H04R 1/026* (2013.01); *H04R 1/2888* (2013.01); *H04R 5/02* (2013.01); *H04R 2201/02* (2013.01); *H04R 2205/024* (2013.01)

(58) Field of Classification Search
CPC ..... H04R 1/025; H04R 1/026; H04R 1/2892; H04R 1/2896; H04R 1/02; H04R 5/023; H04R 2201/02; H04R 2201/025
See application file for complete search history.

(56) References Cited

U.S. PATENT DOCUMENTS 4,778,027 A * 10/1988 Taylor ..... A61H 23/0236 181/141
5,147,986 A * 9/1992 Cockrum ..... H04R 1/2842 181/145
5,193,118 A * 3/1993 Latham-Brown ..... B60R 11/0217 381/302
5,602,367 A * 2/1997 Meyer ..... H04R 1/2819 181/145
5,607,308 A * 3/1997 Copperman ..... A63F 13/005 434/62
6,463,160 B1 * 10/2002 Tracy ..... H04R 1/025 381/332

(Continued)

*Primary Examiner* — Fan S Tsang
*Assistant Examiner* — Angelica M McKinney
(74) *Attorney, Agent, or Firm* — Plager Schack LLP; Mark H. Plager; Eric Liou

(57) ABSTRACT

A modular auditory low frequency sound reproduction and vibration generating speaker enclosure platform system for use to support a seating apparatus includes a main housing having a top wall, a bottom wall, a front wall, a rear wall, and a pair of side walls forming an internal chamber, a subwoofer speaker coupled to the main housing, an amplifier electrically coupled to the subwoofer, and a plurality of reflex ports coupled to the front wall of the main housing. The top wall of the main housing is designed to support the seating apparatus thereon. The amplifier is designed to activate the subwoofer to generate the sound pressure waves that project from the speaker to the seating apparatus and throughout the main housing. The generated sound pressure waves transferred along the top wall of the main housing delivers tremulous movement to the seating apparatus situated thereon.

8 Claims, 4 Drawing Sheets

(56) References Cited

U.S. PATENT DOCUMENTS

| | | | | |
|---|---|---|---|---|
| 6,801,633 | B2 * | 10/2004 | Tracy | H04R 1/345 181/141 |
| 9,820,032 | B1 * | 11/2017 | Zhang | H04R 1/2865 |
| 2005/0047622 | A1 * | 3/2005 | Graber | H04R 1/2865 381/342 |
| 2013/0301861 | A1 * | 11/2013 | Ho | H04R 1/023 381/332 |
| 2015/0172799 | A1 * | 6/2015 | O'Neal | H04R 1/025 381/77 |
| 2016/0192046 | A1 * | 6/2016 | Pietschmann | H04R 1/026 381/336 |
| 2017/0150264 | A1 * | 5/2017 | Nelson | A61H 23/0236 |
| 2018/0146281 | A1 * | 5/2018 | Spero | H04R 1/24 |

* cited by examiner

AUDITORY LOW FREQUENCY SOUND REPRODUCTION AND VIBRATION GENERATING SPEAKER ENCLOSURE PLATFORM SYSTEM

RELATED APPLICATION

The application claims priority to provisional U.S. patent application Ser. No. 62/658,038 filed on Apr. 16, 2018, the entire contents of which is herein incorporated by reference.

BACKGROUND

The embodiments herein relate generally to subwoofer speakers.

Low frequency sound reproduction also known as bass, when produced by modern subwoofer speaker enclosures, simulate realistic sound. However, this bass lacks efficiencies in naturally producing the tactile by-product or feeling accompanied with the organic origination of sound. In order to provide for accurate recreation of the originating low frequency sound, a blending of both auditory and vibratory elements are needed simultaneously to the listener in a convenient and efficient method to completely experience the intended reproduction. For low frequency sound waves to resonate within the listener, to feel the impact of sound, the waves need to travel the necessary wavelength to reach peak efficiency.

With modern subwoofer speaker enclosures, the relative proportional distance away from the listener must be met, which requires ample space. With the added distance, other challenging factors form, the increased power required to overcome the distance and the number of available positions in allocable space may be restricted in order to add additional speaker enclosures if desired. Although known to be omnidirectional, low frequency sound waves emanating from modern subwoofer speaker enclosures placed in various corners of the room, usually consisting of one enclosure, cause the perceptional sound to be profoundly sensed from those placed positions. In addition, to provide for an immersive envelopment of low frequency sound, the size of modern subwoofer speaker enclosures are required to be fundamentally large and are limited, requiring both an abundant amount of space and an inconvenient placement within the room.

Currently, the only way to acoustically amplify, with low efficiency, the vibratory tactile effect from modern subwoofer speaker enclosures is to increase the applied power, increase the size of the enclosure relative to the driver, and increase the number of enclosures. Modern subwoofer speaker enclosures inherently lack the vibratory tactile connection to the embodiment of sound to the listener. To attempt to overcome their limited vibratory tactile range, in most situations an elevated amplitude beyond its nominal operation with inefficiency and distortion must be exerted. Without the physical connection to the enclosure and direct sound wave propagation capture, any attempt to naturally achieve the necessary vibratory tactile effect is futile. In addition, modern subwoofer speaker enclosures do not provide sufficient cabinet space and the necessary placement of components in order to establish a true reproduction of the auditory and vibratory components recorded from the source.

As such, there is a need in the industry for an auditory low frequency sound reproduction and vibration generating speaker enclosure platform system that addresses the limitations of the prior art. There is a need for the enclosure platform system to have high efficiency and the vibratory tactile effect necessary to enable users to completely experience the intended acoustic reproduction with high auditory fidelity in a unique convenient manner.

SUMMARY

In certain embodiments, a modular auditory low frequency sound reproduction and vibration generating speaker enclosure platform system for use to support a seating apparatus thereon is provided. The system is configured to deliver sound pressure waves and tremulous movement directly to the seating apparatus to create an enhanced auditory and vibratory experience. The speaker enclosure platform system comprises a main housing comprising a top wall, a bottom wall opposite the top wall, a front wall connecting the top and bottom walls together, a rear wall connecting the top and bottom walls together, and a pair of side walls connecting the top and bottom walls together and the front and rear walls together, the top, bottom, front, rear and side walls forming an internal chamber, a subwoofer coupled to the main housing and comprising a speaker oriented generally upright that partially extends across the top wall of the main housing, an amplifier electrically coupled to the subwoofer, and a plurality of reflex ports coupled to the front wall of the main housing, each reflex port in the plurality of reflex ports comprising an opening connecting the internal chamber of the main housing to an area surrounding the system to vent sound pressure waves generated by the subwoofer that are captured within the main housing, wherein the top wall of the main housing is configured to support the seating apparatus thereon in proximity to the speaker of the subwoofer, wherein the amplifier is configured to activate the subwoofer to generate the sound pressure waves that project from the speaker outward directly to the seating apparatus and throughout the main housing, wherein a portion of the generated sound pressure waves transferred along the top wall of the main housing delivers the tremulous movement to the seating apparatus situated thereon.

In an alternative embodiment, the speaker enclosure platform system comprises a main housing comprising a top wall, a bottom wall, a front wall, a rear wall, a pair of side walls, and a plurality of dividing walls to form a plurality of internal chambers within the main housing, a plurality of subwoofers coupled to the main housing, each subwoofer extending within one of the plurality of internal chambers in the main housing and comprising a speaker oriented generally upright that partially extends across the top wall of the main housing, at least one amplifier electrically coupled to the plurality of subwoofers, and a plurality of reflex ports coupled to the front wall of the main housing.

BRIEF DESCRIPTION OF THE FIGURES

The detailed description of some embodiments of the invention will be made below with reference to the accompanying figures, wherein the figures disclose one or more embodiments of the present invention.

DETAILED DESCRIPTION OF CERTAIN EMBODIMENTS

Figure 1:
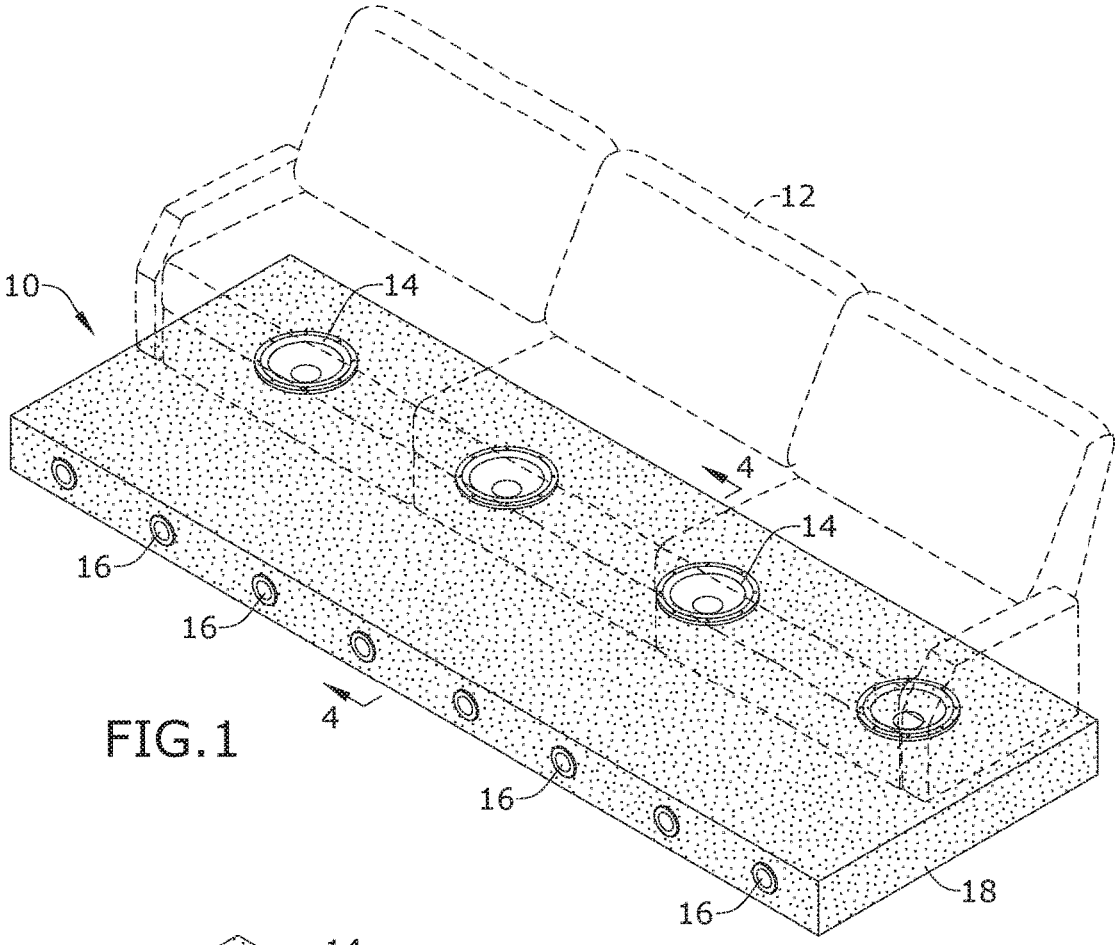
FIG. 1 depicts a perspective view of certain embodiments of the standalone subwoofer speaker enclosure platform system shown in use.

In certain embodiments of the invention as depicted in FIGS. 1-4, standalone subwoofer speaker enclosure platform system 10 is disposed on the ground and is configured to support a seating apparatus such as couch 12 thereon. Standalone subwoofer speaker enclosure platform system 10 is configured to deliver sound pressure waves and tremulous movement directly to couch 12 to create an enhanced auditory and vibratory experience for a user seated on couch 12. It shall be appreciated that standalone subwoofer speaker enclosure platform system 10 can be used to support any number and type of seating apparatuses including, but not limited to, chairs, stools, seats, couches and sofas.

In certain embodiments, standalone subwoofer speaker enclosure platform system 10 generally comprises a housing formed by upper plywood sheeting 22, lower plywood sheeting 24, front wood frame wall 26, rear wood frame wall 28 and wood dividing walls 30, subwoofers 14, reflex ports 16 and binding post cups 20.

Figure 3:
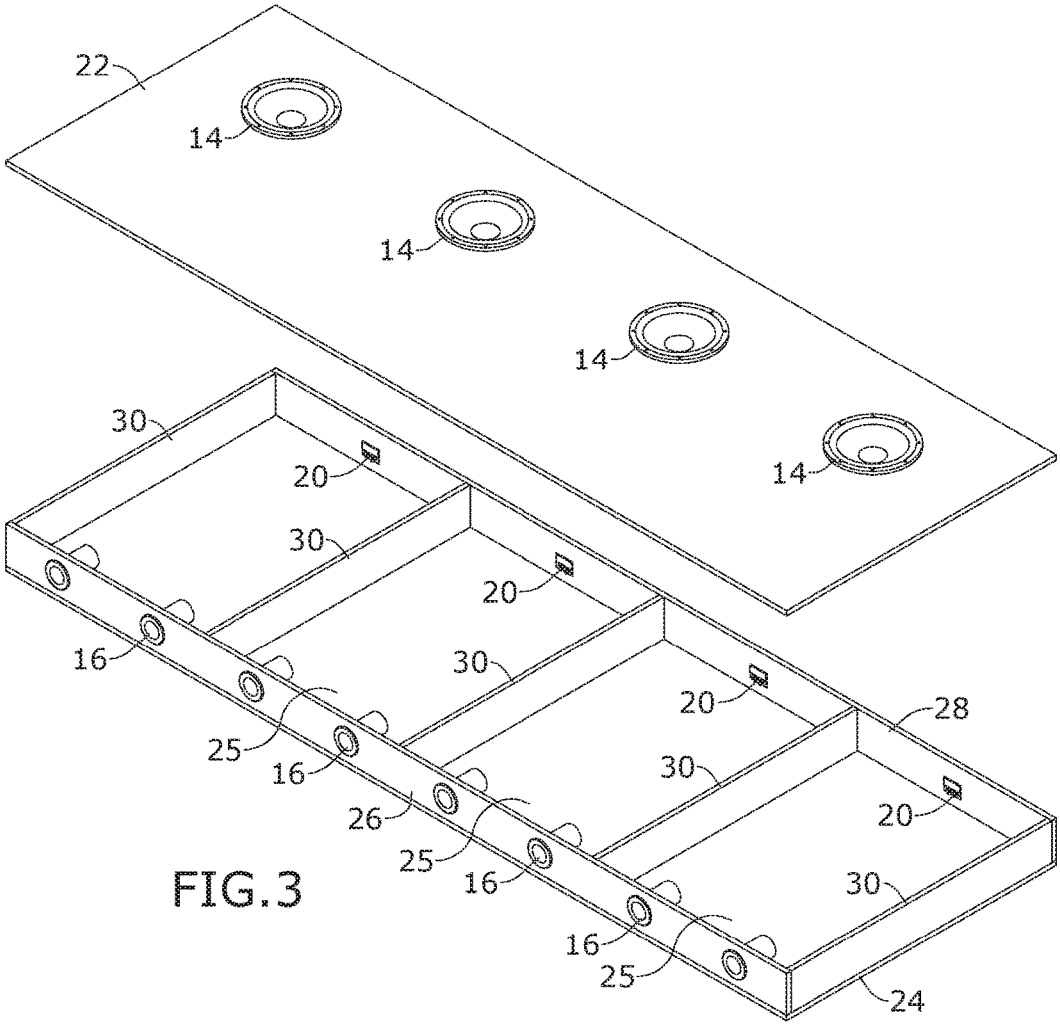
FIG. 3 depicts a perspective view of certain embodiments of the standalone subwoofer speaker enclosure platform system with the top exploded and the fabric layer removed.

Upper plywood sheeting 22, lower plywood sheeting 24, front wood frame wall 26, rear wood frame wall 28 and wood dividing walls 30 can be secured together using mechanical fasteners or other fastening components. As depicted in FIG. 3, upper plywood sheeting 22, lower plywood sheeting 24, front wood frame wall 26, rear wood frame wall 28 and wood dividing walls 30 of the housing together form a plurality of internal chambers 25 within the housing.

The components of the housing may comprise variable dimensions. In one embodiment, each sheeting in upper and lower plywood sheeting 22, 24 comprises a thickness of approximately ¾". In one embodiment, each member in front wood frame wall 26, rear wood frame wall 28 and dividing walls 30 comprises a thickness within the approximate range of 1¾"-2", but a preferable thickness of approximately 2". Although components of the housing are preferably made from wood, it shall be appreciated that the housing can be made from alternative materials known in the field.

In one embodiment, fabric layer 18 is disposed around the housing to enhance grip and prevent couch 12 or another seating apparatus from sliding off upper plywood sheeting 22 of the housing. In one embodiment, fabric layer 18 is a carpet or other similar type of fabric. Fabric layer 18 is coupled to the housing of standalone subwoofer speaker enclosure platform system 10 using an adhesive and/or mechanical fasteners.

Figure 4:
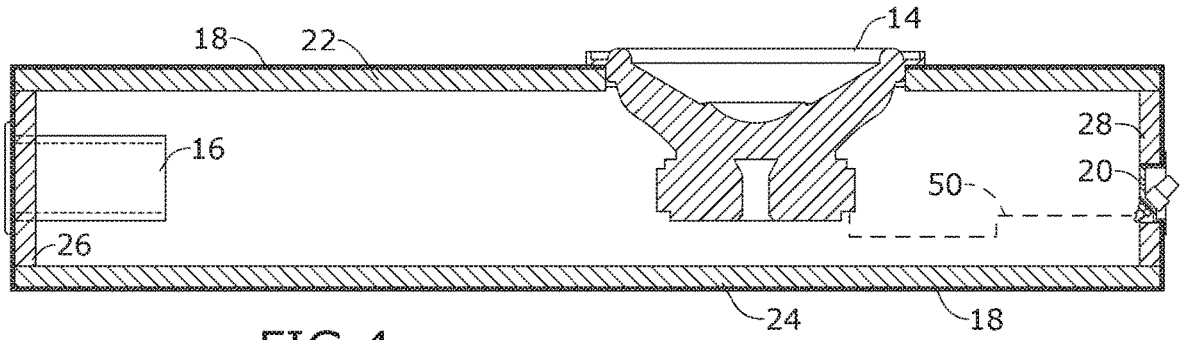
FIG. 4 depicts a section view of certain embodiments of the standalone subwoofer speaker enclosure platform system, taken along line 4-4 in FIG. 1.

In certain embodiments as depicted in FIGS. 1-4, a plurality of subwoofers 14 is coupled to upper plywood sheeting 22. More specifically, each subwoofer 14 extends within one of the plurality of internal chambers 25 and comprises a speaker oriented generally upright that partially extends across upper plywood sheeting 22 of the housing as depicted in FIG. 4. Each subwoofer 14 extends through an opening in upper plywood sheeting 22 and comprises an upper portion that extends across upper plywood sheeting 22 proximate the opening. Additional fastening components may be used to secure each subwoofer 14 to the housing in an alternative embodiment.

In a preferred embodiment, each subwoofer 14 is configured to deliver sound wave frequencies within the approximate range of 20-200 Hz. However, it shall be appreciated that the size and specifications of subwoofers 14 can vary. Subwoofers 14 are operably connected to a corresponding speaker terminal as is known in the field.

In certain embodiments as depicted in FIGS. 1 and 3-4, a plurality of reflex ports 16 are coupled to openings in front wood frame wall 26. In a preferred embodiment, a pair of reflex ports 16 are positioned to connect one of the plurality of internal chambers 25 within the housing to the area surrounding standalone subwoofer speaker enclosure platform system 10. As such, reflex ports 16 create openings that allow air and sound pressure waves to oscillate in and out of the housing. Reflex ports 16 are dimensionally tuned in length and diameter in relation to the cubic area in internal chamber 25 and specifications of subwoofer 14 for optimal operating efficiency.

Figure 2:
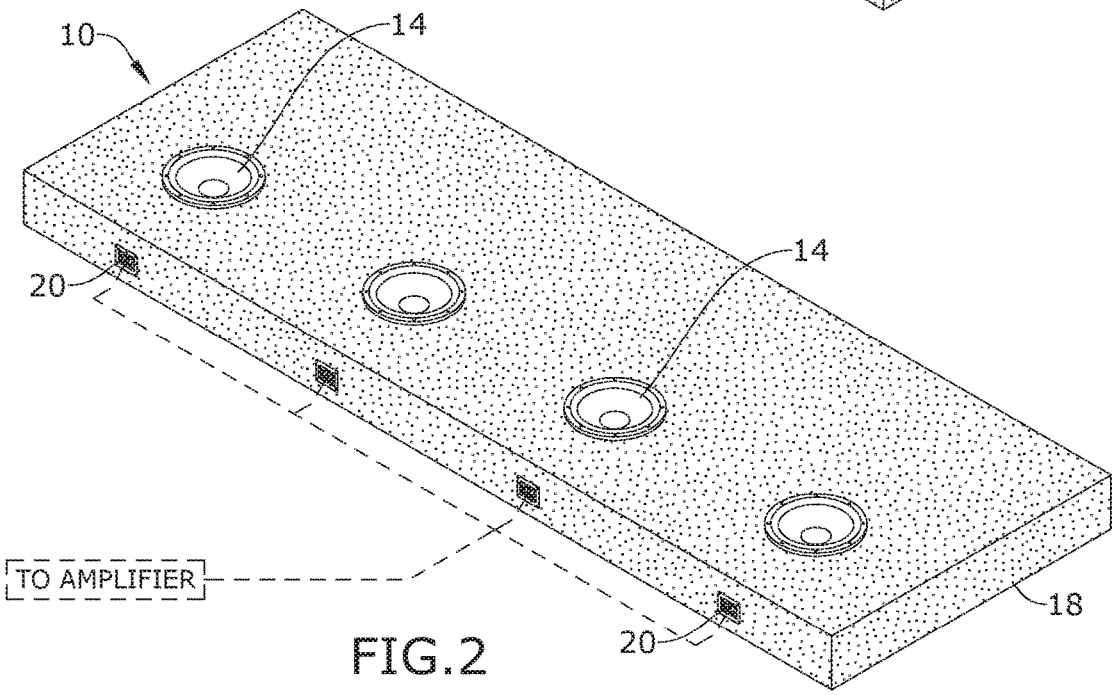
FIG. 2 depicts a rear perspective view of certain embodiments of the standalone subwoofer speaker enclosure platform system.

In certain embodiments, a plurality of binding post cups 20 is coupled to openings in rear wood frame wall 28. In a preferred embodiment, each binding post cup 20 is electrically coupled to subwoofer 14 by wire 50 internally within the housing and electrically coupled to an external amplifier by wire outside of the housing of standalone subwoofer speaker enclosure platform system 10 as depicted in FIGS. 2 and 4. The amplifier is configured to supply power and control the operation of each connected subwoofer 14. It shall be appreciated that one or multiple amplifiers can be electrically coupled to binding post cups 20 to control the operation of subwoofers 14 in standalone subwoofer speaker enclosure platform system 10 so long as the amplifiers are within the nominal power and impedance ranges for subwoofers 14.

In operation of standalone subwoofer speaker enclosure platform system 10, the housing is disposed on the ground so that couch 12 or another seating apparatus is supported by carpet 18 and upper plywood sheeting 22. Couch 12 is disposed entirely on, partially on or in proximity to subwoofers 14. Subwoofers 14 are electrically coupled to all corresponding systems as is known in the field. The amplifier is controlled by a user to activate the one or more subwoofers 14.

For each activated subwoofer 14, the speaker of the subwoofer generates sound pressure waves that project outward directly to couch 12, and throughout internal chamber 25 to the walls and plywood sheeting of the housing. At the same time, a portion of the generated sound pressure waves transferred along upper plywood sheeting 22 and carpet 18 is directly transferred in the form of tremulous movement to couch 12, which is seated thereon. During this time, the generated sound pressure waves captured within internal chamber 25 are vented through the corresponding pair of reflex ports 16 to the surrounding environment of standalone subwoofer speaker enclosure platform system 10. This allows subwoofer 14 to operate efficiently and effectively. Ultimately, the simultaneous deliverance of sound pressure waves and tremulous movement directly to couch 12 as described creates an enhanced auditory and vibratory experience for a user seated on couch 12.

Figure 5:
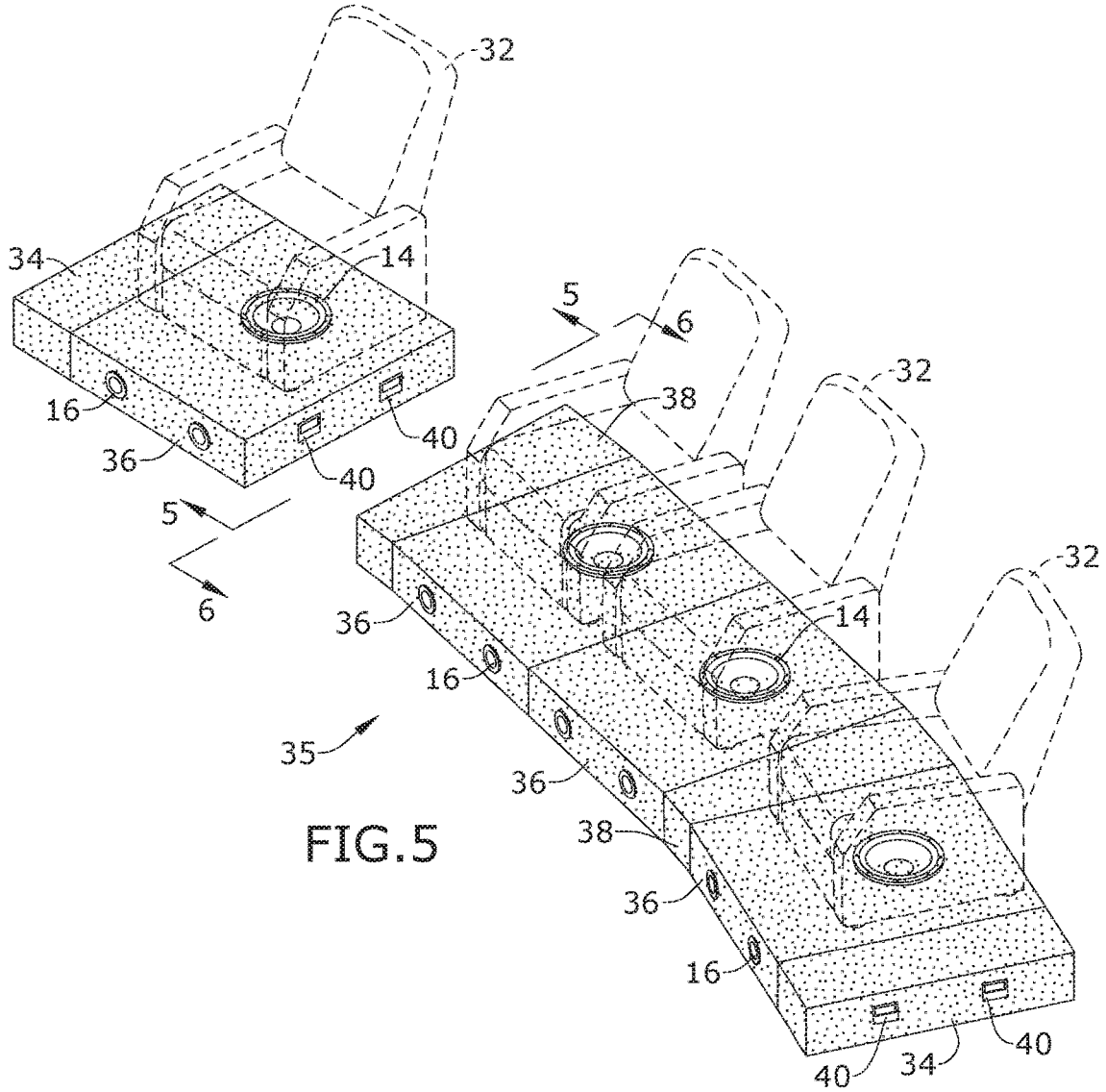
FIG. 5 depicts a perspective view of an alternate embodiment of a modular subwoofer speaker enclosure platform system shown in use.

The configuration of standalone subwoofer speaker enclosure platform system 10 can vary. In an alternative embodiment as depicted in FIGS. 5-8, modular subwoofer speaker enclosure platform system 35 comprises components substantially similar to standalone subwoofer speaker enclosure platform system 10. In certain embodiments, modular subwoofer speaker enclosure platform system 35 comprises any number of modular subwoofer speaker enclosure platforms 36, linear spacers 34 and radial spacers 38 connected together as depicted in FIG. 5 to form the desired configuration.

As depicted in FIG. 5, linear spacers 34 and radial spacers 38 comprise components substantially similar to the housing in standalone subwoofer speaker enclosure platform system 10. In one embodiment, each linear spacer 34 comprises a rectangular top wall, a rectangular bottom wall, a front wall connecting the rectangular top and bottom walls together, a rear wall connecting the rectangular top and bottom walls together, and a pair of side walls connecting the rectangular top and bottom walls together and the front and rear walls together.

The walls of linear spacer 34 can be secured together using mechanical fasteners or other fastening components. The walls of linear spacer 34 can be made from wood or alternative materials known in the field. In one embodiment, a fabric layer such as carpet is disposed around the walls of linear spacer 34.

In one embodiment, each radial spacer 38 comprises a top wall, a bottom wall, a front wall connecting the top and bottom walls together, a rear wall connecting the top and bottom walls together, and a pair of side walls connecting the top and bottom walls together and the front and rear walls together. In radial spacer 38, the front wall comprises a first surface area that is less than a second surface area of the rear wall.

In one embodiment, modular subwoofer speaker enclosure platform system 35 is configured to support any number of seating apparatuses such as chairs 32 thereon. It shall be appreciated that modular subwoofer speaker enclosure platform system 35 is configured to support any number and type of alternative seating apparatuses including, but not limited to, other chairs, stools, seats, couches and sofas.

In certain embodiments, each modular subwoofer speaker enclosure platform 36 comprises a housing with an internal chamber formed by upper plywood sheeting 22, lower plywood sheeting 24, front wood frame wall 26, rear wood frame wall 28 and wood dividing walls 30 coupled together as previously described in standalone subwoofer speaker enclosure platform system 10. Modular subwoofer speaker enclosure platform 36 also comprises subwoofer 14, a pair of reflex ports 16, binding post cup 20, wire 50 and at least one amplifier connected together in the same manner described in standalone subwoofer speaker enclosure platform system 10.

Wood dividing walls 30 on opposing sides of each modular subwoofer speaker enclosure platform 36 comprise fasteners that are configured to detachably couple with corresponding fasteners on either side wall of linear spacer 34 or radial spacer 38 to secure any number of modular subwoofer speaker enclosure platforms 36, linear spacers 34 and radial spacers 38 together as depicted in FIG. 5. These fasteners create a latching system between connected components. It shall be appreciated that the fasteners in the latching system can be made from any materials known in the field including, but not limited to, steel, other metals, wood, plastic, rubber, and the like.

Figure 6:
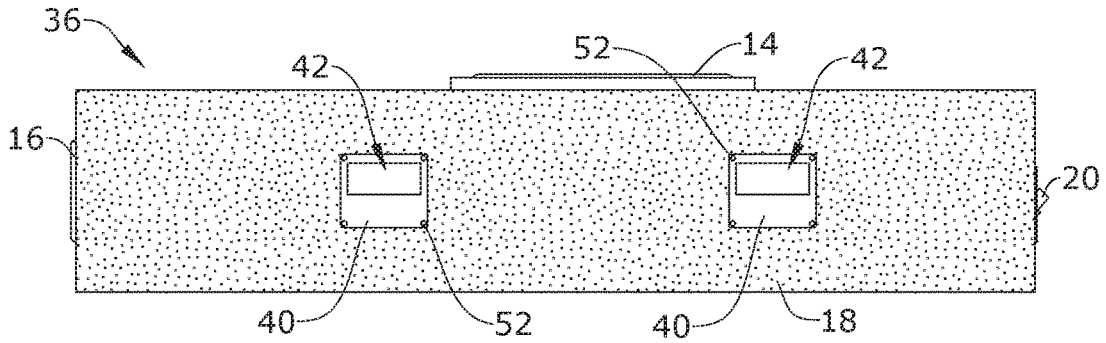
FIG. 6 depicts a side view of the alternate embodiment of the modular subwoofer speaker enclosure platform system.
Figure 8:
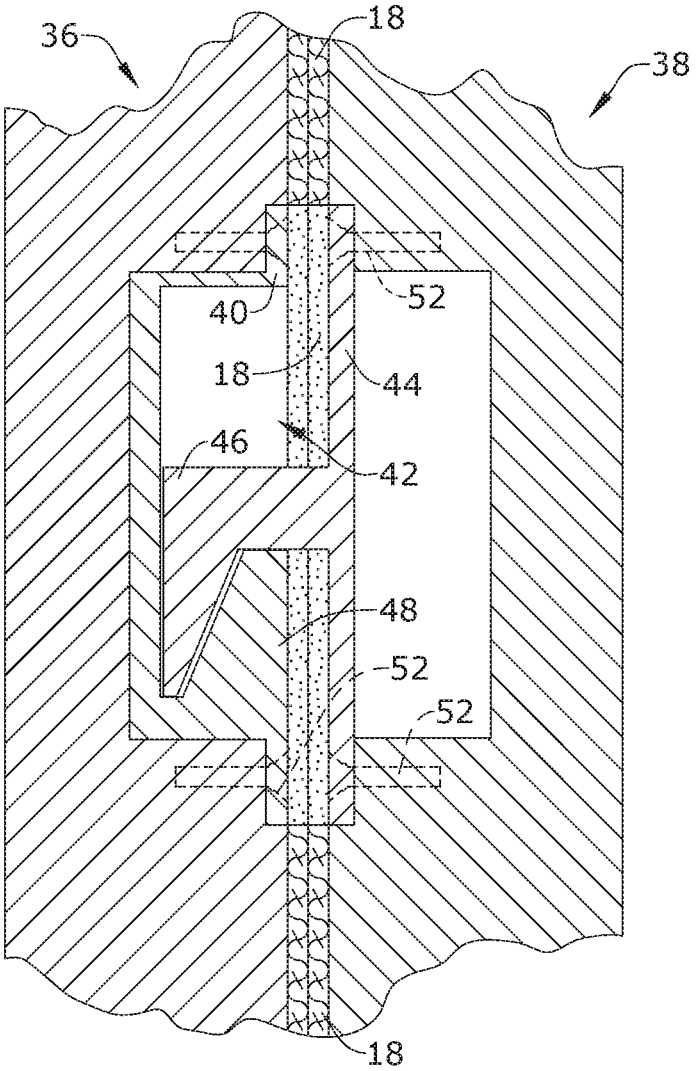
FIG. 8 depicts a section view of the alternate embodiment of the modular subwoofer speaker enclosure platform system, taken along line 8-8 in FIG. 7, and illustrating the coupling of radial spacer 38 and modular subwoofer speaker enclosure platform 36 together.

In a preferred embodiment, the latching system comprises corresponding sets of female and male fasteners that engage with each other. In one embodiment as depicted in FIGS. 5-6 and 8, each modular subwoofer speaker enclosure platform 36 comprises female locking fasteners 40 coupled to one or both side wood dividing walls 30 by screws 52 or other fastening components. Each female locking fastener 40 comprises male locking fastener opening 42. Female locking fasteners 40 on modular subwoofer speaker enclosure platform 36 are configured to detachably couple with corresponding male locking fasteners 46 present on a side wall of linear spacer 34 or radial spacer 38.

Figure 7:
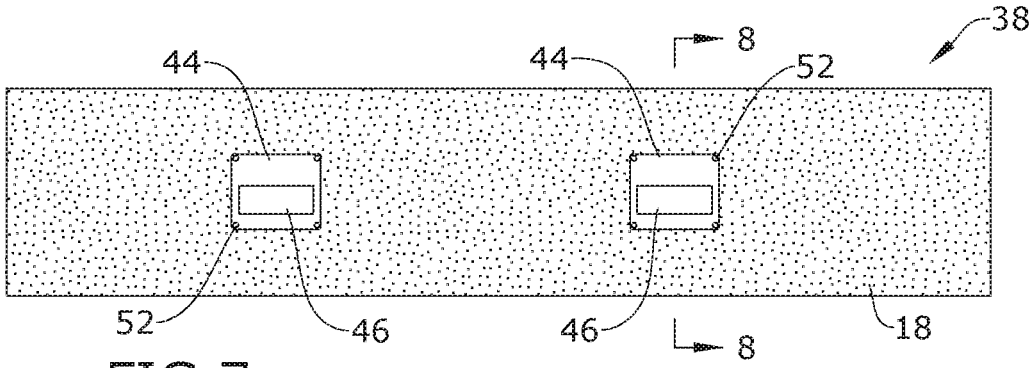
FIG. 7 depicts a side view of the alternate embodiment of the modular subwoofer speaker enclosure platform system illustrating radial spacer 38.

In one embodiment as shown in FIG. 7, male locking fasteners 46 are coupled to one or both side walls of radial spacer 38 by screws 52. Each male locking fastener 46 comprises male locking fastener plate 44. In one embodiment, male locking fasteners 46 can be coupled to one or both side walls of linear spacer 34 in the same manner.

In one embodiment as depicted in FIG. 8, the connection between male locking fastener 46 and female locking fastener 40 is illustrated. More specifically, each female locking fastener 40 comprises male locking fastener opening 42 to receive male locking fastener 46. In one embodiment, each female locking fastener 40 comprises receiving lip 48 that engages with male locking fastener 46 in the secured position.

It shall be appreciated that the fasteners on modular subwoofer speaker enclosure platform 36, linear spacer 34 and radial spacer 38 can be interchanged or replaced with alternative fastening components to secure any number of modular subwoofer speaker enclosure platforms 36, linear spacers 34 and radial spacers 38 together.

In operation of modular subwoofer speaker enclosure platform system 35, any number of modular subwoofer speaker enclosure platforms 36, linear spacers 34 and radial spacers 38 are connected together by engaging corresponding fasteners together to form a desired configuration as depicted in FIG. 5. Other configurations of connected modular subwoofer speaker enclosure platforms 36, linear spacers 34 and radial spacers 38 can be constructed in alternative embodiments depending on user preferences. Any number of chairs 32 are disposed entirely on, partially on or in proximity to subwoofers 14 on the corresponding modular subwoofer speaker enclosure platforms 36. Subwoofers 14 are electrically coupled to all corresponding systems as is known in the field.

Modular subwoofer speaker enclosure platform system 35 is operated in substantially the same manner as standalone subwoofer speaker enclosure platform system 10 as previously described. The amplifier is controlled by a user to activate the one or more subwoofers 14. For each activated subwoofer 14, the speaker of the subwoofer generates sound pressure waves that project outward directly to chair 32, and throughout the internal chamber to walls and plywood sheeting of the housing. At the same time, a portion of the generated sound pressure waves transferred along upper plywood sheeting 22 and carpet 18 is directly transferred in the form of tremulous movement to chair 32, which is seated thereon. During this time, the generated sound pressure waves captured within the internal chamber are vented through the corresponding pair of reflex ports 16 to the surrounding environment of modular subwoofer speaker enclosure platform system 35. This allows subwoofer 14 to operate efficiently and effectively. Ultimately, the simultaneous deliverance of sound pressure waves and tremulous movement directly to chairs 32 as described creates an enhanced auditory and vibratory experience for any users seated on chairs 32.

Is shall be appreciated that the subwoofer speaker enclosure platform systems described can be used in a wide variety of applications including the field of therapy. With the subwoofer speaker enclosure platform system placed as it would, normally being on the ground and as an ancillary foundation to a seating apparatus, other apparatuses such as therapeutic or medical beds, massage tables and the like could be used as a suitable replacement for the seating apparatus. With the enclosure platform and supporting apparatus in place, the facility or institution could provide a wide range of low frequency sound waves to the patient, causing the vibratory tactile by-product to penetrate the cellular medium in accordance with the applicable application(s).

It shall be appreciated that the components of the subwoofer speaker enclosure platform systems described in several embodiments herein may comprise any alternative known materials in the field and be of any color, size and/or dimensions. It shall be appreciated that the components of the subwoofer speaker enclosure platform systems described herein may be manufactured and assembled using any known techniques in the field.

Persons of ordinary skill in the art may appreciate that numerous design configurations may be possible to enjoy the functional benefits of the inventive systems. Thus, given the wide variety of configurations and arrangements of embodiments of the present invention, the scope of the invention is reflected by the breadth of the claims below rather than narrowed by the embodiments described above.

What is claimed is:

1. A modular auditory low frequency sound reproduction and vibration generating speaker enclosure platform system for use to support a seating apparatus thereon, the system configured to deliver sound pressure waves and tremulous movement directly to the seating apparatus to create an enhanced auditory and vibratory experience, the speaker enclosure platform system comprising:

a main housing comprising a top wall, a bottom wall opposite the top wall, a front wall connecting the top and bottom walls together, a rear wall connecting the top and bottom walls together, and a pair of side walls connecting the top and bottom walls together and the front and rear walls together, the top, bottom, front, rear and side walls forming an internal chamber;

a subwoofer coupled to the main housing and comprising a speaker oriented generally upright that partially extends across the top wall of the main housing;

an amplifier electrically coupled to the subwoofer;

a plurality of reflex ports coupled to the front wall of the main housing, each reflex port in the plurality of reflex ports comprising an opening connecting the internal chamber of the main housing to an area surrounding the system to vent sound pressure waves generated by the subwoofer that are captured within the main housing; and a binding post cup coupled to the rear wall of the main housing and electrically coupled to both the subwoofer and amplifier;

wherein the top wall of the main housing is configured to directly contact and support the seating apparatus thereon in proximity to the speaker of the subwoofer, wherein the subwoofer is positioned off-center in the internal chamber of the main housing a first separation distance away from the binding post cup that is less than a second separation distance away from the plurality of reflex ports, wherein the amplifier is configured to activate the subwoofer to generate the sound pressure waves that project from the speaker outward directly to the seating apparatus and throughout the main housing, wherein a portion of the generated sound pressure waves transferred along the top wall of the main housing delivers the tremulous movement to the seating apparatus situated thereon.

2. The speaker enclosure platform system of claim 1, wherein the subwoofer extends within the internal chamber of the main housing.

3. The speaker enclosure platform system of claim 2, further comprising a second housing comprising a top wall, a bottom wall opposite the top wall, a front wall connecting the top and bottom walls together, a rear wall connecting the top and bottom walls together, and a pair of side walls connecting the top and bottom walls together and the front and rear walls together, the top, bottom, front, rear and side walls of the second housing forming an internal chamber, one of the pair of side walls in the second housing disposed on one of the pair of side walls in the main housing, a second subwoofer coupled to the second housing and comprising a second speaker oriented generally upright that partially extends across the top wall of the second housing, a second amplifier electrically coupled to the second subwoofer, and a plurality of reflex ports coupled to the front wall of the second housing, each reflex port in the second housing comprising an opening connecting the internal chamber of the second housing to the area surrounding the system to vent sound pressure waves generated by the second subwoofer that are captured within the second housing, wherein the top wall of the second housing is configured to support another seating apparatus thereon in proximity to the second speaker of the second subwoofer.

4. The speaker enclosure platform system of claim 3, wherein each side wall in the main housing and second housing comprises a first set of fasteners coupled thereto.

5. The speaker enclosure platform system of claim 4, further comprising a linear spacer comprising a generally rectangular top wall, a generally rectangular bottom wall, a front wall connecting the generally rectangular top and bottom walls together, a rear wall connecting the generally rectangular top and bottom walls together, and a pair of side walls connecting the generally rectangular top and bottom walls together and the front and rear walls together, each side wall in the pair of side walls in the linear spacer comprising a second set of fasteners configured to detachably couple with the first set of fasteners on any side wall in the main housing and second housing.

6. The speaker enclosure platform system of claim 5, further comprising a radial spacer comprising a top wall, a bottom wall, a front wall connecting the top and bottom walls together, a rear wall connecting the top and bottom walls together, and a pair of side walls connecting the top and bottom walls together and the front and rear walls together, the front wall of the radial spacer comprising a first surface area that is less than a second surface area of the rear wall of the radial spacer, each side wall in the pair of side walls in the radial spacer comprising a third set of fasteners configured to detachably couple with the first set of fasteners in any side wall in the main housing and second housing.

7. The speaker enclosure platform system of claim 6, further comprising a first fabric layer disposed around the main housing and configured to contact the seating apparatus and a second fabric layer disposed around the second housing and configured to contact the another seating apparatus.

8. An auditory low frequency sound reproduction and vibration generating speaker enclosure platform system for use to support a seating apparatus thereon, the system configured to deliver sound pressure waves and tremulous movement directly to the seating apparatus to create an enhanced auditory and vibratory experience, the speaker enclosure platform system comprising:

a main housing comprising a top wall, a bottom wall opposite the top wall, a front wall connecting the top and bottom walls together, a rear wall connecting the top and bottom walls together, and a pair of side walls connecting the top and bottom walls together and the front and rear walls together, and a plurality of dividing walls coupled to the front, rear, top and bottom walls to form a plurality of internal chambers within the main housing;

a plurality of subwoofers coupled to the main housing, each subwoofer in the plurality of subwoofers extending within one of the plurality of internal chambers in the main housing and comprising a speaker oriented generally upright that partially extends across the top wall of the main housing;

at least one amplifier electrically coupled to the plurality of subwoofers;

a plurality of reflex ports coupled to the front wall of the main housing, each pair of reflex ports in the plurality of reflex ports comprising a pair of openings connecting one of the plurality of internal chambers in the main housing to an area surrounding the system to vent sound pressure waves generated by the subwoofer corresponding to the one of the plurality of internal chambers captured within the one of the plurality of internal chambers; and a plurality of binding post cups coupled to the rear wall of the main housing with each binding post cup in the plurality of binding post cups coupled to one of the plurality of internal chambers in the main housing, each binding post cup in the plurality of binding post cups being electrically coupled to both one of the plurality of subwoofers and the at least one amplifier;

wherein the top wall of the main housing is configured to directly contact and support the seating apparatus thereon, wherein each subwoofer in the plurality of subwoofers is positioned off-center in one of the plurality of internal chambers of the main housing, a first separation distance away from the binding post cup that is less than a second separation distance away from the pair of reflex ports in the internal chamber, wherein the at least one amplifier is configured to activate one of the plurality of subwoofers to generate the sound pressure waves that project from the speaker of the one of the plurality of subwoofers outward directly to the seating apparatus and throughout the main housing, wherein a portion of the generated sound pressure waves transferred along the top wall of the main housing delivers the tremulous movement to the seating apparatus situated thereon.

* * * * *